United States Patent [19]

Tucker

[11] Patent Number: 5,035,386

[45] Date of Patent: Jul. 30, 1991

[54] PAINTBRUSH HOLDER

[76] Inventor: Francis C. Tucker, 200 Summit Ave., Mingo Junction, Ohio 43938

[21] Appl. No.: 585,677

[22] Filed: Sep. 20, 1990

[51] Int. Cl.[5] ..... A46B 17/02

[52] U.S. Cl. ..... 248/110; 248/303

[58] Field of Search ..... 248/110, 111, 112, 113, 248/210, 211, 238, 213.2, 303, 302; 211/65; 206/209; 220/90

[56] References Cited

U.S. PATENT DOCUMENTS 2,284,452 5/1942 Simons .
2,466,850 4/1949 Hoffman et al. .
2,641,367 6/1953 Wetzel et al. .
4,025,206 5/1977 Rubin ..... 248/112 X
4,721,225 1/1988 Sobel ..... 220/90
4,832,293 5/1989 Gizzi ..... 248/110
4,890,353 1/1990 Shannon et al. ..... 248/110 X

*Primary Examiner*—Ramon O. Ramirez
*Attorney, Agent, or Firm*—Oliff & Berridge

[57] ABSTRACT

Paintbrush holders which each include a first leg having a first end and a second end, the first end being attached to a brush support and a second leg, the second end being attached to a stabilizer which fits within the lid groove of a paint can.

18 Claims, 1 Drawing Sheet

PAINTBRUSH HOLDER

FIELD OF THE INVENTION

The present invention relates to a paintbrush holder, more particularly, a paintbrush holder adapted to engage the lid groove of a conventional paint can.

BACKGROUND OF THE INVENTION

When painting using a conventional paintbrush or other paint application device, it is frequently necessary and/or desirable to set down the paintbrush. Typically, one lays the paintbrush down on a surface or across the mouth of an open paint can. Since the paintbrush is usually laden with wet paint, when such action is taken, paint frequently drips or runs, eventually ending up in undesired locations.

In efforts to remedy this problem, prior art attempts have been made to provide paintbrush holders. However, such prior art attempts have suffered from one or more of various drawbacks. For example, paintbrush holders have been proposed which are extremely cumbersome, making them (1) inconvenient in use, e.g., when attaching to a paint can or when transferring from one paint can to another or (2) partially or completely blocking access to paint within a paint can. Also, complicated structures are generally more expensive and require more steps to manufacture. Another problem with many prior art paintbrush holders is that the paintbrush holder does not sufficiently rigidly attach to a paint can. As a result, e.g., excessive care must be exercised when mounting the paintbrush on the paintbrush holder and/or the paintbrush and paintbrush holder sometimes topple off of the paint can.

SUMMARY OF THE INVENTION

In accordance with the present invention, there is provided a paintbrush holder which is easy to manufacture, which can be easily attached to a paint can, and which can remain in position on the paint can without interfering with access to paint within the paint can.

Paintbrush holders in accordance with the present invention comprise a first leg having first and second ends, a second leg having an attached end and a free end, the attached end of the second leg being attached to the first end of the first leg, an arc-shaped stabilizer attached to the second end of the first leg, and a brush support attached to the first end of the first leg. The present invention further provides such a paintbrush holder in which the arc-shaped stabilizer is positioned within the lid groove of a paint can.

The arc-shaped stabilizer is preferably substantially coplanar with the free end of the second leg.

The arc-shaped stabilizer preferably defines an arc of a circle which is of slightly greater diameter than the diameter of a circle defined by the outer wall of the lid groove of a conventionally-sized paint can.

BRIEF DESCRIPTION OF THE DRAWING FIGURES

The present invention may be more fully understood with reference to the accompanying drawings and the following description of the embodiments shown in those drawings. The invention is not limited to the exemplary embodiments and should be recognized as contemplating all modifications within the skill of an ordinary artisan.

DETAILED DESCRIPTION OF THE PREFERRED EMBODIMENTS

Figure 1:
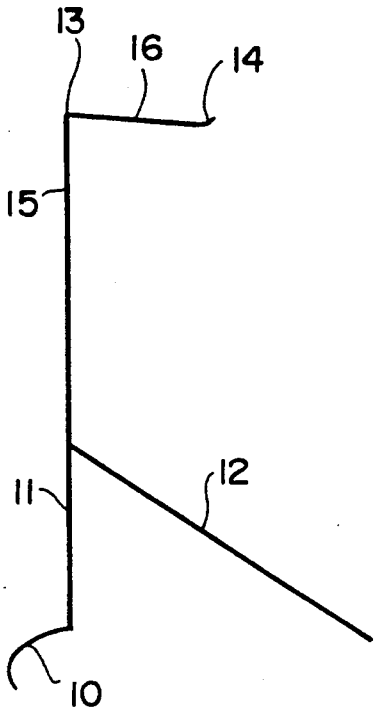
FIG. 1 is a perspective view of a preferred paintbrush holder in accordance with the present invention.

The present invention provides a paintbrush holder which comprises a first leg having a first end and a second end and a second leg having an attached end and a free end, an arc-shaped stabilizer and a brush support. The brush support and the attached end of the second leg are attached to the first end of the first leg, and the arc-shaped stabilizer is attached to the second end of the first leg. The arc-shaped stabilizer and the free end of the second leg form a base which, when in use, rests on a paint can. The arc-shaped stabilizer preferably defines an arc of a circle having a diameter slightly larger than the diameter of the outer wall of a lid groove of a conventionally-sized paint can, i.e., the stabilizer is of slightly smaller curvature than the outer wall of the lid groove. For example, the outer wall diameter of the lid groove of a conventionally-sized one-gallon paint can is approximately 6.0 inches, while that of a conventionally-sized one-quart paint can is approximately 3.7 inches. Accordingly, a paintbrush holder in accordance with the present invention designed for use with a conventionally-sized one-gallon paint can preferably includes a stabilizer which defines an arc of a circle having a diameter of from about 6.1 inches to about 6.3 inches, most preferably approximately 6.2 inches, and one designed for a conventionally-sized one-quart paint can preferably defines an arc of a circle having a diameter of from about 3.8 inches to about 4.0 inches, most preferably approximately 3.9 inches.

When a paintbrush holder in accordance with the present invention is being attached to a paint can, the free end (the end which is not connected to the first leg) of the stabilizer is inserted into the lid groove of the paint can, and pressure is applied to the paint brush holder so as to slightly bend the arc-shaped stabilizer such that it completely fits into the lid groove which is of slightly greater curvature than the stabilizer. The free end of the second leg is preferably substantially coplanar with the stabilizer, such that it fits into the outer groove of the paint can (adjacent the lid groove) at a location separate from the stabilizer. Since the outer groove is typically not precisely coplanar with the lid groove, the free end of the second leg need not be precisely coplanar with the stabilizer.

In preferred embodiments, in which the stabilizer defines an arc of a circle of a slightly greater diameter than the diameter of the outer wall of the lid groove, the stabilizer is formed of a material having memory, i.e., a material which can be slightly bent to fit within the lid groove and which returns to its original shape after being removed from the lid groove. Accordingly, when such a stabilizer is positioned within a lid groove, the stabilizer presses against the outer wall of the lid groove, such that it is securely held within the lid groove. Although preferred sizes and curvatures of the stabilizer are discussed herein, it should be recognized that a variety of dimensional characteristics could be provided in the stabilizer without departing from the spirit and scope of the invention.

The brush support comprises any suitable means for suspending a paintbrush (or any other paint application device), preferably such that any paint which drips from the paintbrush returns to the paint can and such that neither the first leg nor the second leg interferes with the paintbrush.

FIG. 1 depicts a preferred embodiment in accordance with the present invention. The embodiment shown in FIG. 1 comprises a brush support 13 attached to a first end of a first leg 11 and an attached end of a second leg 12, and an arc-shaped stabilizer 10 attached to a second end of the first leg 11. In this embodiment, the arc-shaped stabilizer 10 and a free end of the second leg 12 are substantially coplanar, i.e., the entire stabilizer 10 substantially defines a plane in which the free end of the second leg 12 is located.

In the embodiment shown in FIG. 1, the brush support 13 includes a first portion 15, a second portion 16 and a brush hook 14. The first portion 15 of the brush support 13 is perpendicular to the second portion 16 of the brush support 13, and the first portion 15 is colinear with the first leg 11. The first leg 11 and the first portion 15 of the brush support 13 together define a line segment which is perpendicular to the plane defined by the stabilizer 10.

The brush hook 14 is on the end of the second portion 16 opposite the first portion 15 and comprises a portion which is bent slightly upwardly, i.e., in a direction away from the plane defined by the stabilizer 10.

Figure 2:
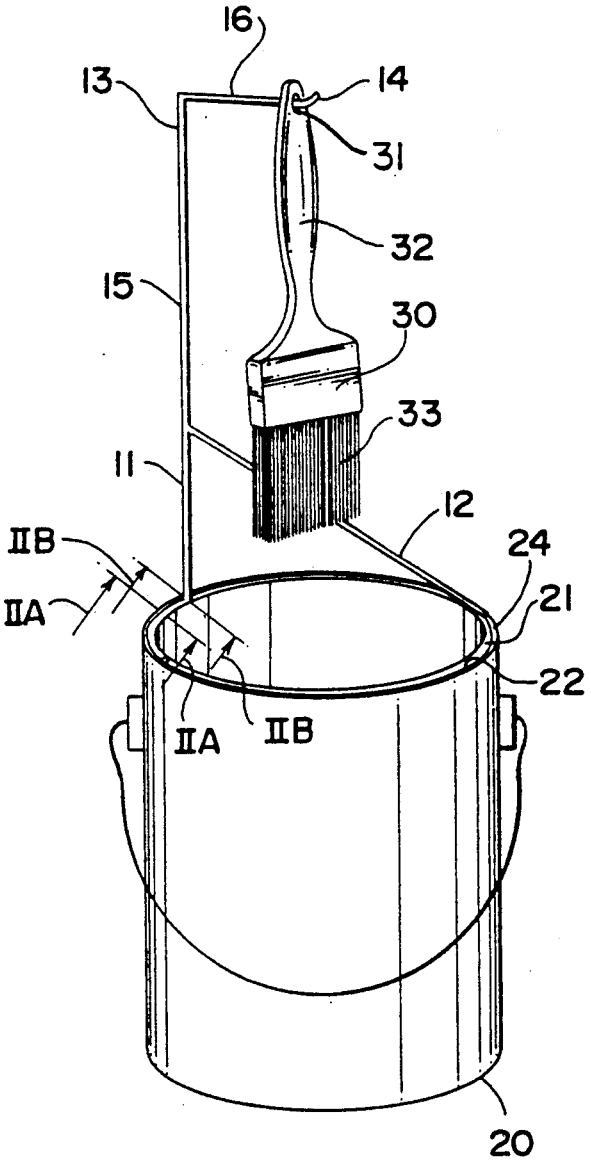
FIG. 2 is a perspective view of a paint can with a preferred paintbrush holder in accordance with the present invention attached thereto, the paintbrush holder being shown with a paintbrush supported thereon.

FIG. 2 depicts the paintbrush holder of FIG. 1 securely attached to a paint can 20 having a lid groove 21. As is evident from a comparison of FIG. 1 with FIG. 2, when the paintbrush holder is securely positioned in the lid groove 21 of the paint can 20, the stabilizer 10 is slightly bent to be of slightly greater curvature.

Figure 3:
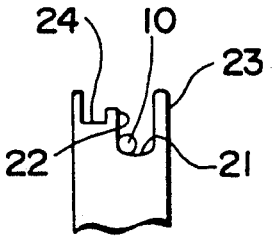
FIG. 3 is a partial sectional view along the plane defined by lines IIA—IIA and IIB—IIB in FIG. 2.

A standard paint can as shown in FIGS. 2 and 3 includes a rim 23 which defines the mouth of the can, a lid groove 21 having an outer wall 22 and an outer groove 24 adjacent the lid groove 21. Referring to FIG. 3, the stabilizer 10 abuts against the outer wall 22 of the lid groove 21, thereby providing secure engagement of the paintbrush holder with the paint can.

A conventional paintbrush such as the one shown in FIG. 2 includes bristles 33 (or other paint distributing medium) and a handle 32. The embodiment shown in FIG. 2 is particularly suitable for use with a paintbrush which has a hole 31 in the handle 32, the hole being positioned such that the center of gravity is between the bristles 33 and the hole 31. When such a paintbrush is hung as shown in FIG. 2, the bristles 33 extend downward relative to the handle 32. In FIG. 2, a paintbrush 30 is shown hanging from the brush support 13, the hole 31 in the handle of the paintbrush 30 having been engaged with and slid over the brush hook 14.

In the embodiment shown in FIG. 2 (as with the one shown in FIG. 1), the second leg 12 and the second portion 16 of the brush support 13 are not coplanar, such that the second leg 12 does not interfere with the brush 30 hanging from the brush support 13, or with engaging the brush 30 on the brush support 13. Moreover, any paint which drips from the brush 30 when in the position shown in FIG. 2 falls directly into the paint can 20 and does not fall on the second leg 12. In addition, the arrangement shown in FIG. 2 allows for easy access to the paint within the paint can 20, even when one or more brush is hanging on the brush support 13.

Although FIG. 2 depicts a brush hook 14, any suitable means for supporting a paintbrush or other paint application device may be employed as part of the brush support 13.

As discussed above, at least the arc-shaped stabilizer 10 is preferably formed of a material having memory, i.e., a material which, when bent to be of a slightly altered curvature, exerts force toward returning to its original curvature.

For this purpose, any of a number of materials is suitable, e.g., many metal materials and plastic materials. For instance, a preferred material comprises wire formed of steel, copper, aluminum, or any other suitable metal.

The remainder of the paintbrush holder is preferably formed of the same material as the stabilizer, although different materials can be used for different parts of the paintbrush holder. In making a paintbrush holder according to the invention, it is preferred to form the brush support 13, the first leg 11 and the stabilizer 10 integrally, e.g., by bending a single piece of metal, and then attaching the second leg 12, e.g., by welding. However, the present invention contemplates forming the paintbrush holder by any suitable technique, such as by molding, or by attaching any number of pieces by any method of attachment, so long as the paintbrush holder operates substantially as described above.

In accordance with a first particularly preferred embodiment, a paintbrush holder is shaped as shown in FIG. 1 and is formed of metal having a circular cross-section of a diameter slightly smaller than $\frac{1}{8}$ inch. In this first particularly preferred embodiment, the length of the stabilizer is about 3.2 inches, the length of the first leg is about 3:1 inches, the length of the second leg is about 6.2 inches, the length of the first portion of the brush support is about 6.2 inches and the length of the second portion of the brush support is about 2.8 inches. The arc-shaped stabilizer defines an arc of a circle having a diameter of about 6.2 inches. The second leg defines an angle of about 60° with respect to the first leg.

The first particularly preferred embodiment is particularly suited for use with a standard one-gallon paint can, in which the width of the lid groove is about 0.2 inch and the outer wall of the lid groove defines a circle having a diameter of about 6.0 inches.

In a second particularly preferred embodiment in accordance with the present invention, the paintbrush holder is also shaped as shown in FIG. 1. The second particularly preferred embodiment is formed of metal having a circular cross-section of a diameter slightly smaller than 0.1 inch. The length of the stabilizer is about 2.1 inches, the length of the first leg is about 3.1 inches, the length of the second leg is about 4.3 inches, the length of the first portion of the brush support is about 5.0 inches and the length of the second portion of the brush support is about 2.2 inches. The arc-shaped stabilizer defines an arc of a circle having a diameter of about 3.9 inches. The second leg defines an angle of about 45° with respect to the first leg.

The second particularly preferred embodiment is particularly suited for use with a standard one-quart paint can, in which the width of the lid groove is about 0.1 inch and the outer wall of the lid groove defines a circle having a diameter of about 3.7 inches.

Although the embodiment shown in FIG. 2 is depicted with a conventional paintbrush which is hung by a hole 31 in the handle 32, the present invention contemplates any type of paint application device, e.g., paint sponges, etc., and the brush support may be formulated in any way which can function to support the paint application device.

Although the present invention has been described in connection with preferred embodiments in which a paintbrush is supported above the level of liquid in the paint can, the present invention also contemplates embodiments in which a paintbrush is hung such that the bristles of the paintbrush are submerged in liquid contained in the paint can. Such embodiments are particularly useful for supporting paintbrushes while immersing the bristles in paint thinner.

Although the paintbrush holder in accordance with the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A paintbrush holder comprising:

a first leg having a first end and a second end;

a second leg having an attached end and a free end, said attached end being attached to said first end of said first leg;

an arc-shaped stabilizer attached to said second end of said first leg; and a brush support attached to said first end of said first leg, said stabilizer substantially defining an arc of a circle having a diameter slightly larger than the diameter of the outer wall of a lid groove of a conventionally-sized paint can.

2. A paintbrush holder as recited in claim 1, wherein said stabilizer substantially defines an arc of a circle having a diameter of from about 6.1 inches to about 6.3 inches.

3. A paintbrush holder as recited in claim 1, wherein said stabilizer substantially defines an arc of a circle having a diameter of from about 3.8 inches to about 4.0 inches.

4. A paintbrush holder as recited in claim 1, wherein said stabilizer and said free end of said second leg are substantially coplanar, defining a plane from which said first leg extends away.

5. A paintbrush holder as recited in claim 4, wherein said first leg is substantially perpendicular to said plane.

6. A paintbrush holder as recited in claim 4, wherein said brush support comprises first and second portions, said first portion of said brush support being substantiallY colinear with said first leg, said second portion of said brush support being substantially perpendicular to said first portion of said brush support.

7. A paintbrush holder as recited in claim 6, wherein said first leg, said second leg and said first portion of said brush support substantially define a second plane from which said second portion of said brush support extends away.

8. A paintbrush holder comprising:

a paint can comprising a generally circular lid groove having an outer wall and an outer groove adjacent said lid groove; and a holder unit comprising an arc-shaped stabilizer removably positioned within said lid groove, a first leg having first and second ends, said second end of said first leg being attached to said stabilizer, a second leg having an attached end and a free end, said attached end being attached to said first end of said first leg, and a brush support attached to said first end of said first leg.

9. A paintbrush holder as recited in claim 8, wherein said arc-shaped stabilizer abuts against said outer wall of said lid groove.

10. A paintbrush holder as recited in claim 8, wherein said free end of said second leg is in said outer groove at a position separate from said stabilizer.

11. A paintbrush holder as recited in claim 8, wherein said first leg is substantially perpendicular to a plane defined by said lid groove.

12. A paintbrush holder as recited in claim 11, wherein said brush support comprises first and second portions, said first portion of said brush support being substantially colinear with said first leg, said second portion of said brush support being substantially perpendicular to said first portion of said brush support.

13. A paintbrush holder as recited in claim 12, wherein said first leg, said second leg and said first portion of said brush support substantially define a second plane from which said second portion of said brush support extends away.

14. A paintbrush holder comprising:

a first leg having a first end and a second end;

a second leg having an attached end and a free end, said attached end being attached to said first end of said first leg;

an arc-shaped stabilizer attached to said second end of said first leg; and a brush support attached to said first end of said first leg;

said stabilizer defining a plane from which said first leg extends away, said free end being spaced from said plane by a small amount so that when said stabilizer is positioned in the lid groove of a conventional paint can, said free end rests in the outer groove of the paint can.

15. A paintbrush holder as recited in claim 14, wherein said first leg is substantially perpendicular to said plane.

16. A paintbrush holder as recited in claim 14, wherein said brush support comprises first and second portions, said first portion of said brush support being substantially colinear with said first leg, said second portion of said brush support being substantially perpendicular to said first portion of said brush support.

17. A paintbrush holder as recited in claim 16, wherein said first leg, said second leg and said first portion of said brush support substantially define a second plane from which said second portion of said brush support extends away.

18. A paintbrush holder as recited in claim 14, wherein said second leg defines an angle other than 90° with respect to said first leg.

* * * * *